US005915545A

United States Patent [19]

Shackel et al.

[11] Patent Number: 5,915,545

[45] Date of Patent: Jun. 29, 1999

[54] CONTACT LENS ACCESSORY KIT

[76] Inventors: Mark Shackel, 219 Eakins Rd., Manhasset, N.Y. 11030; Howard Haut, 70 Sugar Maple Dr., Roslyn, N.Y. 11576

[21] Appl. No.: 09/096,665

[22] Filed: Jun. 12, 1998

[51] Int. Cl.[6] ..... A45C 11/04

[52] U.S. Cl. ..... 206/5.1; 206/5

[58] Field of Search ..... 206/5, 5.1, 6, 38; 224/901.8; 190/102

[56] References Cited

U.S. PATENT DOCUMENTS

| | | | |
|---|---|---|---|
| 3,124,240 | 3/1964 | Croan . | |
| 4,574,944 | 3/1986 | Gregory . | |
| 4,951,811 | 8/1990 | Lines . | |
| 5,381,922 | 1/1995 | Gladman et al. | 224/901.8 |
| 5,456,361 | 10/1995 | Walsh et al. . | |
| 5,513,744 | 5/1996 | Yabarra | 206/6 |
| 5,658,314 | 8/1997 | Scheffer et al. | 224/901.8 |
| 5,676,242 | 10/1997 | Scott | 206/5 |
| 5,706,935 | 1/1998 | Lorton | 206/38 |

OTHER PUBLICATIONS

"Contact Lens Cases" by Optical Journal–Review, p. 36, 'Lens Carrying Kit', Mar. 1959.

*Primary Examiner*—David T. Fidei
*Attorney, Agent, or Firm*—Collard & Roe, P.C.

[57] ABSTRACT

The invention relates to a contact lens carrying case that also attaches to an eyeglass case. The contact lens carrying case is comprised of two flaps connected by a soft hinge. The carrying case contains a series of contact lens holders, with at least two contact lens holders for holding reusable contact lenses and at least two contact lens holders for holding disposable contact lenses. In addition, there are two bottles located on the inside face of the soft hinge. These bottles contain solutions designed to maintain the contact lenses. A mirror connected to a hinge is attached to the first flap, wherein the mirror can be rotated up at an angle of 45 degrees. Furthermore, there are two pouches located on an inside face of the second flap. One set of pouches are designed to hold disinfectant towels, while the other pouches are used to store personal items and information. Finally, there is a set of tissues in a tissue box located on an inside face on the second flap. The combination of these elements provides a full set contact lens organization kit holder in a single carrying case.

7 Claims, 3 Drawing Sheets

CONTACT LENS ACCESSORY KIT

BACKGROUND OF THE INVENTION

1. Field of the Invention

The invention relates to improvements in a carrying case, and more particularly, to a total concept container for eyeglasses and contact lenses.

2. Description of the Prior Art

The use of contact lenses has become widespread and thus, there has been a greater need for lens carrying cases. Lens carrying cases are known in the art. For example, U.S. Pat. No. 4,574,944 to Gregory is a total concept container to facilitate the use and care of contact lenses. The container comprises a first housing section, providing a working area for use during the insertion and removal of a contact lens from the eye. The working area is particularly designed to capture any liquids which may be dropped during insertion.

U.S. Pat. No. 5,456,361 to Walsh et al. discloses a tray provided with receptacles for storing hygienic care items in an organized manner to facilitate their use. This device also includes receptacles for use when administering to personal hygiene, receptacles for rinsing contact lenses, and for receiving used mouthwash. U.S. Pat. No. 4,951,811 to Lines discloses a combined eye glass and contact lens case having a mirror. Finally, U.S. Pat. No. 3,142,240 to Croan discloses a contact lens case having a contact lens holder and a contact lens cleaner.

However, none of the above mentioned inventions contains a contact lens carrying case that houses a mirror, an expandable paper storage area, a storage area for saline wetting solution bottles, a storage area for disposable lenses and a storage area for vital information.

SUMMARY OF THE INVENTION

One object of the invention is to provide an eyeglass and contact lens holder that holds bottles of disposable contacts. Another object of the invention is to provide an eyeglass and contact lens holder that has pouches for paper, tissues, a mirror and saline lubricating solutions. Another object of the invention is to provide a contact lens storage and organizer kit holder that is inexpensive to manufacture and easy to use.

The invention relates to a contact lens carrying case that houses both disposable and reusable lenses. The contact lens holder is book-like having two flaps held together by a soft hinge wherein the open ends are held closed by a zipper. The carrying case opens up to reveal the enclosed lens holders. On a first flap, re-usable lenses are located on a either side of the flap in dual right and left circular shaped contact lens holders. These contact lens holders are placed around a mirror that is used to help a user to put on their contact lenses.

Attached to the binding are two bottle holders for holding two different types of solution. These bottles can be used to clean and/or re-lubricate the re-usable contact lenses located within the contact lens holders. On the second flap are two pouches designed to hold personal items. Additional pouches for disinfectant towelettes are located on either side of the two bottles for housing disposable contact lenses. Between these two pouches are bottles containing disposable contact lenses. At a top end of the bottles are bottle tops that can be screwed off to allow a user to remove contact lenses.

In addition, extending across a back end of the flap is a tissue holder for holding tissues. The tissue holder and tissues are especially important because they allow a user to wipe excess solution from a face and hands after putting the contact lenses on. Finally, the invention includes a series of velcro fasteners connected to an inside face on each flap wherein these fasteners hold the above listed accessories to each flap.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings, wherein similar reference characters denote similar elements throughout the several views.

DESCRIPTION OF THE PREFERRED EMBODIMENTS

Figure 1:
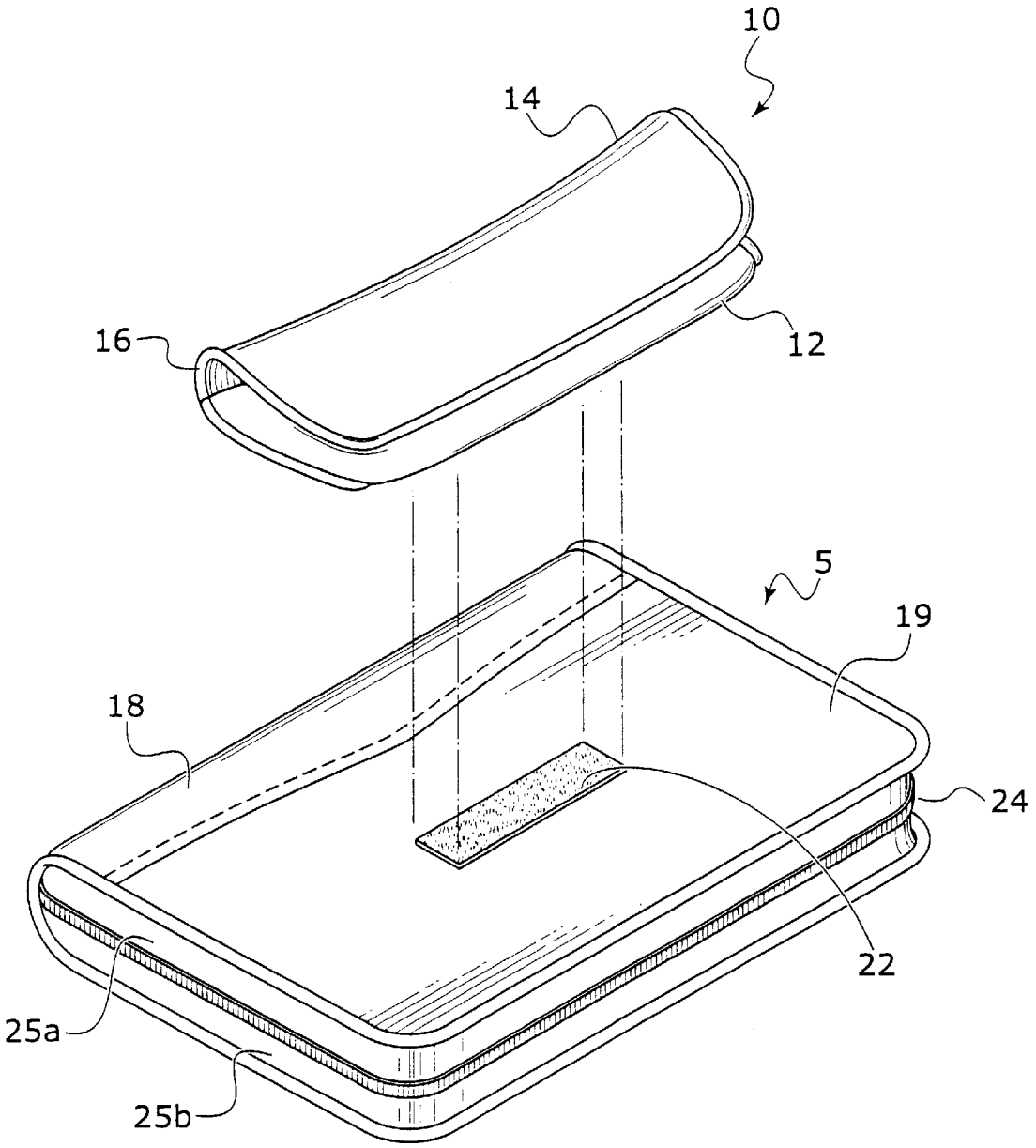
FIG. 1 is a perspective view of the closed eyeglass and contact lens carrying case according to the invention.

FIG. 1 shows a perspective view of the contact lens carrying case 5 and the eyeglass holder 10. Eyeglass holder 10 is shown closed, and comprises a pouch 12, a flap 14 that wraps around pouch 12, and a rim 16 located on flap 14. Pouch 12 carries the actual eyeglasses while flap 14 is designed to hold the eyeglasses within pouch 12.

The closed contact lens carrying case 5, has a soft hinge 18 that holds two flaps 19 and 20 together. (See FIG. 2). The first flap 19 contains a fastener 22 so that eyeglass holder 10 can attach to the contact lens carrying case 5. To keep carrying case 5 closed, a zipper 24 extends around an edge of carrying case 5. Zipper 24 is attached to ends 25*a* and 25*b*, wherein end 25*a* extends in from flap 19, while end 25*b* extends in from flap 20 (See FIG. 2).

Figure 2:
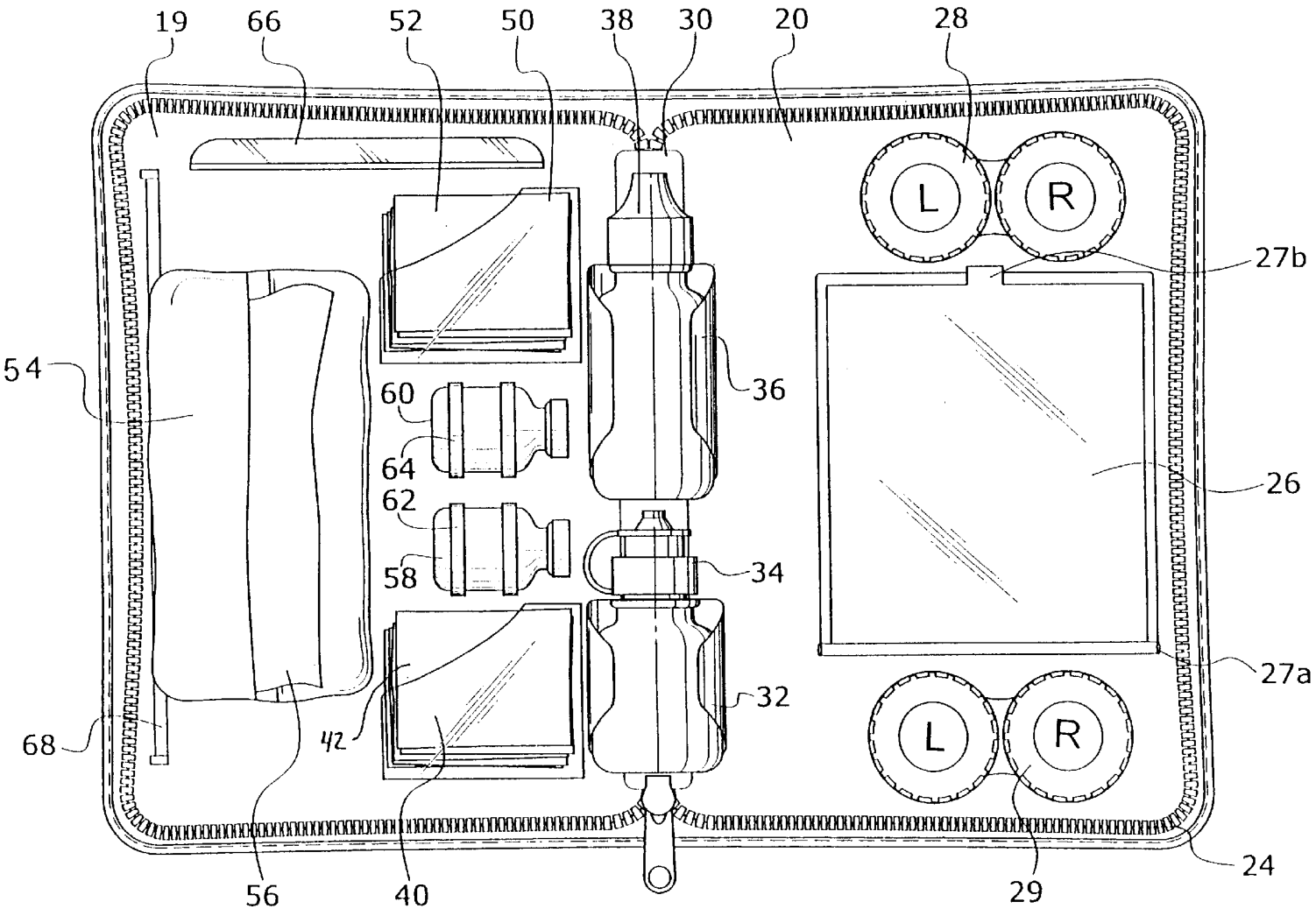
FIG. 2 is a top view of the contact lens holder and carrying case when opened.

FIG. 2 is a top view of carrying case 5, showing open flaps 19 and 20. On an inside portion of flap 20 is flat mirror 26 which helps the user put his contact lenses on. Flat mirror 26 is designed as a plastic non-breakable mirror that is connected to a spring loaded hinge 27*a* and designed to pop up with the aid of protrusion 27*b* at the angle of 35 to 45 degrees. On either side of mirror 26 are contact lens holders 28, and 29 having left and right designations. Connected to flaps 19 and 20 is a support bracket 30 connected to flexible hinge 18. Hinge 18 houses a first cylindrical bottle holder 32, and a second cylindrical bottle holder 36. Located within first cylindrical bottle holder 32 is first bottle 34 for holding a solution. In addition, located within second cylindrical bottle holder 36 is a second bottle 38 having a different solution.

Located on an inside surface of flap 19 is a paper holder 40, for storing disinfectant towels 42 to sanitize skin. In addition, located opposite paper holder 40, is paper holder 50 for holding paper 52. Adjacent to paper holders 40 and 50 is tissue holder 54 for holding tissues 56.

Bottles 58 and 60 are located between pouches 40 and 50. Bottle 58 is held down by elastic straps 62 while bottle 60 is held down by elastic straps 64. Bottles 58 and 60 contain disposable contact lenses.

In addition, flap 19 contains two pouches 66 and 68 that provide storage space for information. Pouch 66 contains a plastic liner that is designed to protect vital perishable information. In addition, pouch 68 is an unlined expandable pouch designed to allow a person to store non-perishable items such as credit cards or other laminated cards. This pouch contains pleats or additional material along its sides to allow pouch 68 to open.

Figure 3:
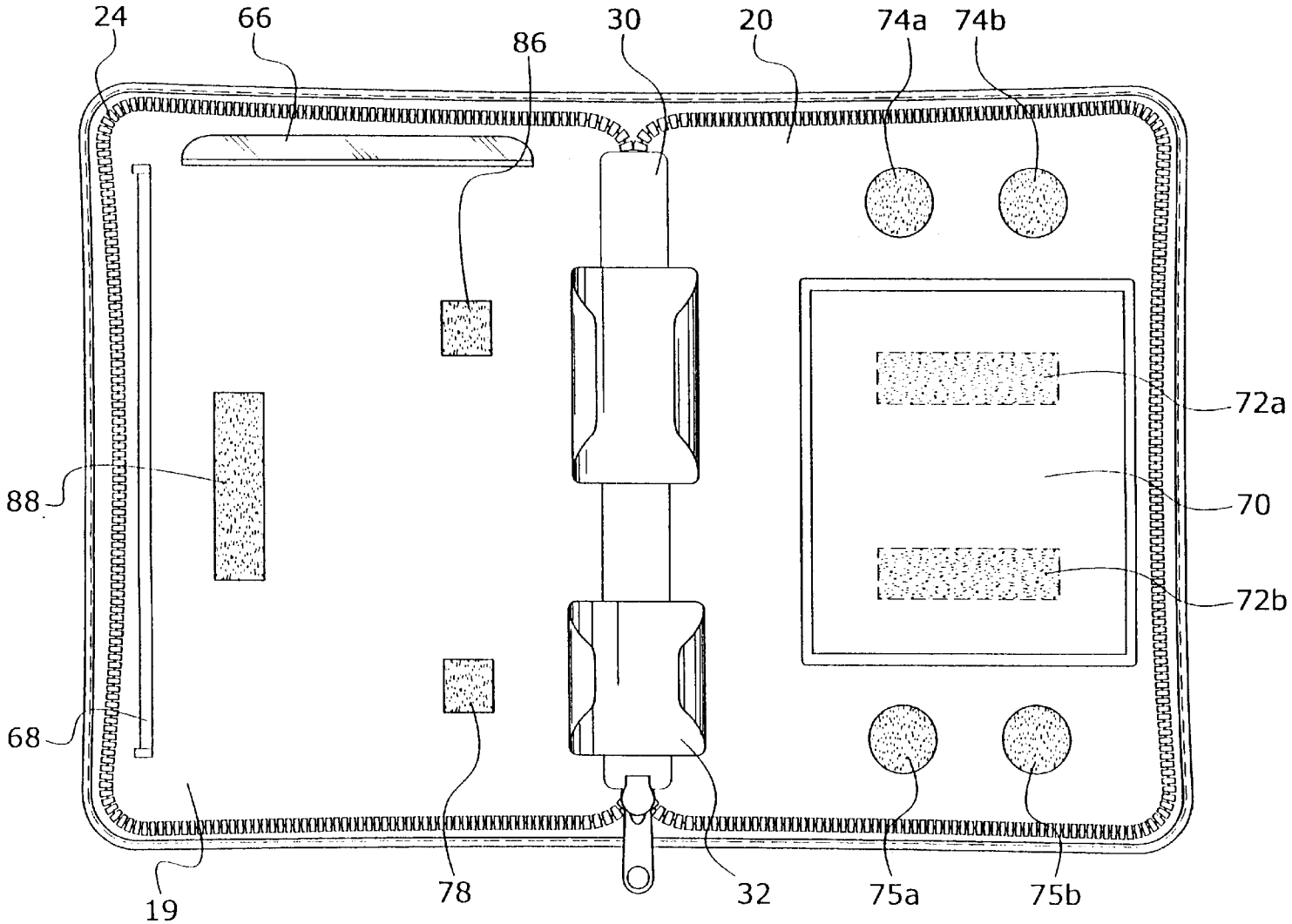
FIG. 3 is a top view of the opened carrying case wherein the contact lens holders, the saline solution the mirror, the pouches and the tissue holder are removed.

FIG. 3 is a top view of opened carrying case 5 that is stripped bare of mirror 26, first contact lens holder 28, and second contact lens holder 29. In addition, carrying case 5 is stripped bare of first bottle solution 34, second bottle solution 38, first paper holder 40, and second paper holder 50, tissue holder 54, bottle 58 and bottle 60. Since these items have been removed, they expose back plate 70 having fasteners 72*a* and 72*b* located on top. Fasteners 72*a* and 72*b* are velcro fasteners and are used to attach to the back of mirror 26. In addition, round fasteners 74*a* and 74*b* as well as 75*a* and 75*b* are used to hold contact lens holders 28 and 29 respectively.

In addition, flap 19 contains fasteners 78 and 86. Fastener 78 is designed to support first paper holder 40 while fastener 86 is designed to support paper holder 50. Finally, rectangular fastener 88 is located on flap 19 and is designed to hold tissue holder 54. These fasteners may comprise velcro hook and loop fastening patches for removeably holding the various accessories to the case.

The carrying case of the present invention is superior to those cases of the prior art because this carrying case houses a mirror, disinfectant towelette storage area, a storage area for saline and lubricating solution bottles, a storage area for bottles having disposable lenses, a storage area for reusable lenses, and a storage area for personal items. All of these elements are included into one contact lens kit holder while the other contact lens cases do not contain bottles having disposable contact lenses.

Accordingly, while only a single embodiment of the present invention has been shown and described, it is to be understood that many changes and modifications may be made thereunto without departing from the spirit and scope of the invention as defined in the appended claims.

What is claimed is:

1. A carrying case for contact lenses comprising:

a first flap having an inside surface and an outside surface;

a second flap having an inside surface and an outside surface;

a soft hinge having an inside surface and an outside surface, said hinge integrally connecting said first and said second flaps together;

a zipper extending around said flaps and designed for holding said carrying case closed;

a fastener connected to said outside surface on said first flap;

an eyeglass case connected to said fastener on said outside surface on said first flap; and a plurality of bottles for holding disposable and daily wear contact lenses, said bottles attached to said inside surface on said first flap.

2. The carrying case as claimed in claim 1, wherein said fastener is a hook and loop type fastener.

3. The carrying case as claimed in claim 1, wherein said carrying case further comprises:

a tissue box connected to said inside face on said first flap; and a plurality of pockets, said pockets connected to said inside face on said first flap.

4. The carrying case as claimed in claim 3, further comprising:

a first contact lens holder attached to said inside surface on said second flap;

a mirror having a reflective top surface and a bottom surface attached to said inside surface on said second flap;

a second contact lens holder attached to said inside surface on said second flap.

5. The carrying case as claimed in claim 4, further comprising a hinge connected between said mirror and said second flap, said hinge allowing said mirror to be raised up and supported at an angle of 45 degrees above said second flap.

6. The carrying case as claimed in claim 4, wherein said mirror further comprises a protrusion connected to said mirror, said protrusion designed to aid in raising said mirror up above said second flap.

7. The carrying case as claimed in claim 1, further comprising:

a first cylindrical bottle holder attached to said inside face on said soft hinge;

a second cylindrical bottle holder attached to said inside surface on said soft hinge;

a first bottle housed within said first bottle holder; and a second bottle housed within said second bottle holder wherein said first and said second bottles contain solution for cleaning and re-lubricating said contact lenses.

* * * * *